US005685104A

United States Patent [19]

Breazeale, Jr.

[11] Patent Number: 5,685,104

[45] Date of Patent: Nov. 11, 1997

[54] GUN REST

[76] Inventor: Robert P. Breazeale, Jr., P.O. Box 80838, Baton Rouge, La. 70898

[21] Appl. No.: 686,917

[22] Filed: Jul. 26, 1996

[51] Int. Cl.[6] ..... F41A 23/18

[52] U.S. Cl. ..... 42/94; 248/287.1

[58] Field of Search ..... 42/94; 89/37.04; 248/287.1, 286.1

[56] References Cited

U.S. PATENT DOCUMENTS

| | | | |
|---|---|---|---|
| 2,340,572 | 2/1944 | Smith | 248/287.1 |
| 3,225,656 | 12/1965 | Flaherty et al. | 89/37.04 |
| 4,345,398 | 8/1982 | Pickett | 42/94 |
| 4,393,614 | 7/1983 | Pickett | 42/94 |
| 4,575,964 | 3/1986 | Griffin | 42/94 |
| 4,934,643 | 6/1990 | Militano, Jr. | 248/287.1 |
| 4,937,965 | 7/1990 | Narvaez | 42/94 |
| 4,967,497 | 11/1990 | Yakscoe | 42/94 |
| 5,284,280 | 2/1994 | Stonebraker, Sr. et al. | 42/94 |
| 5,421,115 | 6/1995 | McKay | 42/94 |
| 5,476,241 | 12/1995 | Helman | 248/286.1 |
| 5,481,817 | 1/1996 | Parker | 42/94 |

FOREIGN PATENT DOCUMENTS

| | | | |
|---|---|---|---|
| 861284 | 2/1941 | France | 42/94 |

*Primary Examiner*—Stephen M. Johnson
*Attorney, Agent, or Firm*—Robert Montgomery

[57] ABSTRACT

A steady rest for guns adaptable to hunters' tree stands having lightweight construction, variable, horizontal, vertical and rotational adjustment.

11 Claims, 2 Drawing Sheets

GUN REST

BACKGROUND OF THE INVENTION

1. Field of the Invention

The present invention relates to gun rests for firearms in general and to gun rests which are adaptable to hunting tree stands in particular.

2. General Background

Steady rests of various types have been used for supporting portions of guns while aiming and firing since firearms have been in existence. Variations of such rests extend from a forked stick to telescopic support rests attached to the weapon itself. Typical gun rests are disclosed in U.S. Pat. No. 4,575,964 where a portable support is used, having telescopic adjustment, for attachment to the hunter's leg or simply placed on the ground. A similar concept is disclosed by U.S. Pat. Nos. 5,481,817 and 4,937,965 whereby a gun rest, having telescopic adjustment, is designed to clamp to a chair. However, these apparatus rely on an adjustable, sliding, arm member at the top of the telescopic member for further support and longitudinal adjustment of the gun support member. Support apparatus which attach to the gun barrel are disclosed in U.S. Pat. Nos. 4,345,398 and 4,393,614. Mountable gun rests have been developed, such as that disclosed by U.S. Pat. No. 5,421,115. However, such supports provide only vertical adjustment with little or no pivotal capability. Although some hunters utilize the safety rails provided on some tree stands as a steady rest, the prior art does not teach the use of a gun rest having universal versatility which allows for a lightweight, telescopic, steady rest to be adapted to tree stands.

SUMMARY OF THE PRESENT INVENTION

The present gun rest comprises a tubular base member, capped at each end and having a length approximately that of an average tree stand's standing platform; a tee fitting, which is slidable along and rotatable about the central axes of the base member and is fitted with a first friction lock nut known as a clutch nut for holding the tee in position relative to the base member; a tubular member telescopically inserted in the perpendicular free end of the tee fitting, which is telescopically adjustable and can be locked in rotatable and linear position with a second clutch nut provided on the tee fitting; and a padded, U-shaped, saddle member attached to the telescopic tubular member for supporting the hand grip or barrel of a gun.

A gun rest in accordance with the invention has various advantageous features. For example, it can be easily attached by U-bolt clamps, provided with the gun rest, for securing the rest to most tree stands. Its light weight does not add appreciably to the weight of the tree stand and its adjustability allows the rest to be infinitely adjusted in all planes while still allowing freedom of movement by the hunter. The rest does not present any fixed obstructions or rely on clamps attached to the hunter's weapon. These features, together with other objects and advantages which will become subsequently apparent, reside in the details of construction and operation as more fully described and claimed hereinafter.

BRIEF DESCRIPTION OF THE DRAWINGS

For a further understanding of the nature and objects of the present invention, reference should be made to the following detailed description, taken in conjunction with the accompanying drawings, in which like parts are given like reference numerals, and wherein.

DESCRIPTION OF THE PREFERRED EMBODIMENT

Figure 3:
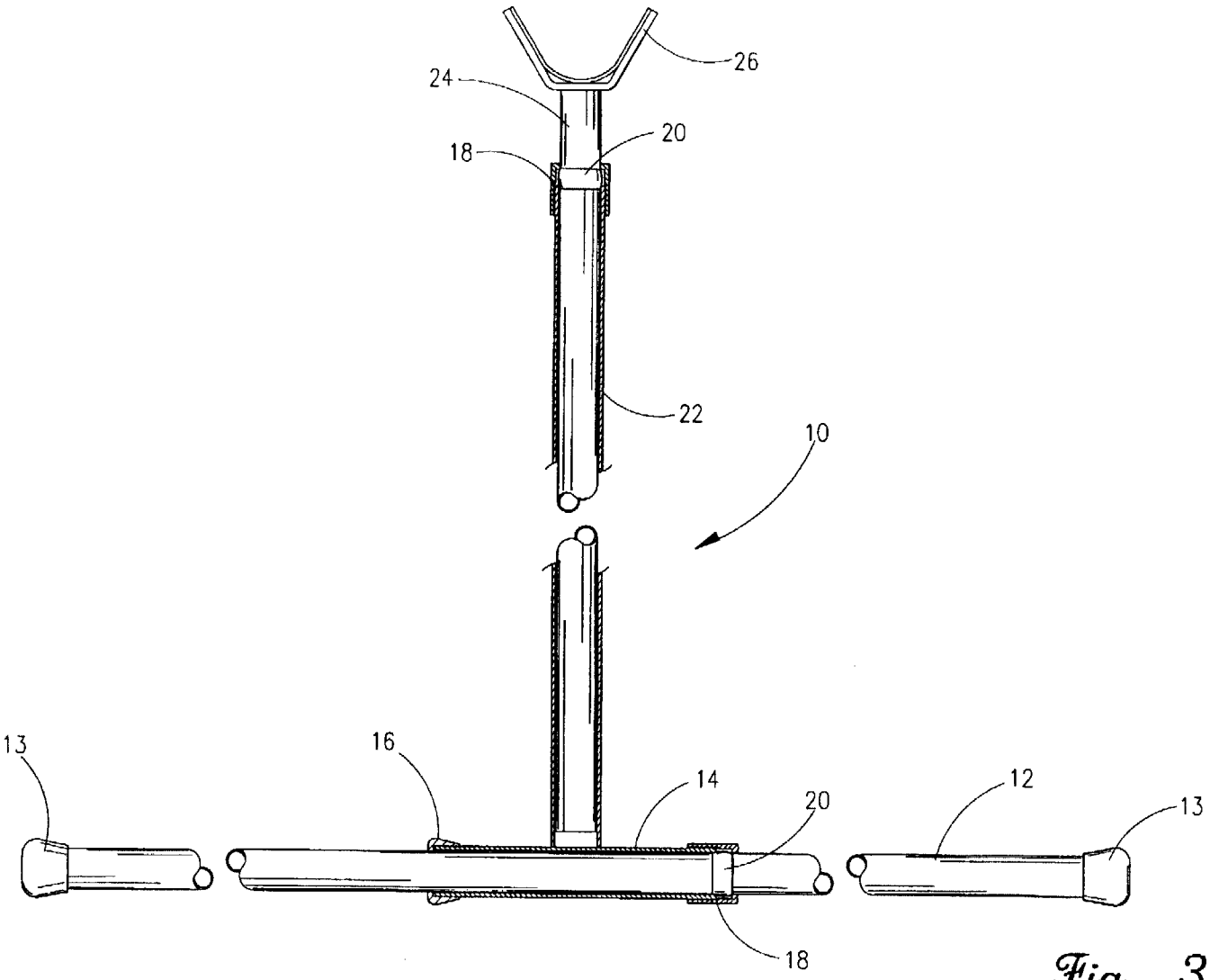
FIG. 3 is a partial cross section of the preferred embodiment.

Turning first to FIG. 3 we see the preferred embodiment 10 in partial cross section comprising: a base element 12 constructed from a hollow cylindrical tube of sufficient length to extend along the width of a typical tree stand, standing platform, its ends capped with rubber cups 13, or other such resilient material, to prevent moisture intrusion; a tee fitting 14 rotatable and slidable about the outside diameter of the base element 12, the tee fitting 14 having a resilient grommet 16 at one end which provides frictional drag between the base element 12 and the tee fitting 14; a clutch nut 18 and ferrule 20 at each of the remaining ends of the tee fitting 14, the perpendicular leg of the tee fitting 14 being extended somewhat longer than the portion of the fitting 14 which is slidable along the base element 12, with the clutch nuts 18 threadably attached to the tee fitting 14 in a manner whereby the ferrule 20 is compressed between the clutch nut 18 and the end of the tee fitting 14, thereby frictionally fixing the fitting 14 securely to the base element 12; and an extendable element 24 inserted telescopically into the elongated portion of the tee fitting 12. A second clutch nut 18 and ferrule 20 is used to secure the extendable element 24 infinitely relative to the tee fitting 14 extended portion 22. The extendable element 24 is also equipped with a padded, U-shaped fitting 26 at one end for resting the hand grip or barrel of a gun.

Figure 1:
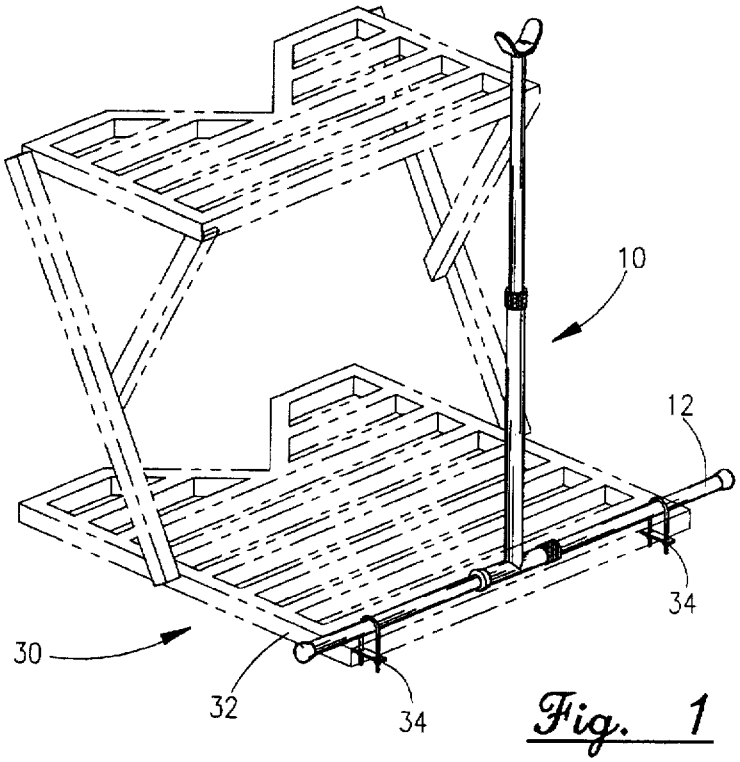
FIG. 1 is an isometric view of the preferred embodiment shown attached to a tree stand.
Figure 2:
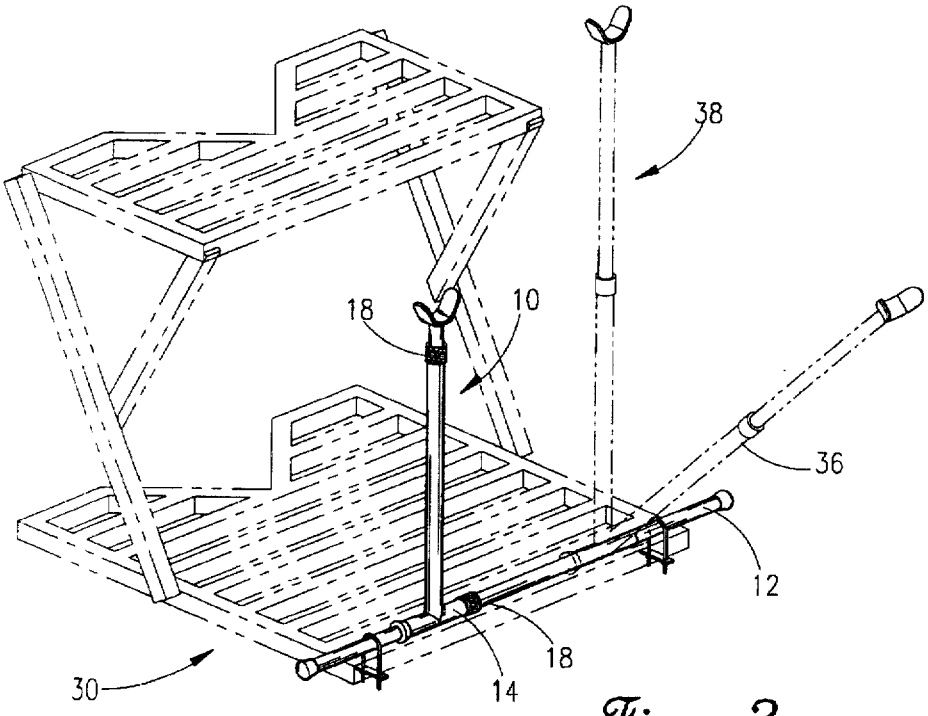
FIG. 2 is an isometric view of the preferred embodiment shown positioned at various positions relative to the tree stand.

As seen in FIG. 1 the preferred embodiment 10 of the invention is attached to the base or standing platform 32 of a hunter's tree stand 30 by means of a pair of U-bolt and bar clamp assemblies 34. The steady gun rest of the present preferred embodiment is adjustable as seen in FIG. 2 by simply loosing the clutch nuts and sliding the tee fitting 14 along the base element 12 or rotationally 36. The rest 10 may also be adjustable longitudinally by loosening the clutch nut 18 at the end of the extended portion 22 of the tee fitting 14, thus allowing the telescoping of the extendable element 24 as seen at item number 38.

Because many varying and different embodiments may be made within the scope of the inventive concept herein taught and because many modifications may be made in the embodiments herein detailed in accordance with the descriptive requirement of the law, it is to be understood that the details herein are to be interpreted as illustrative and not intended to limit the invention.

What is claimed is:

1. A gun rest for attachment to a hunter's tree stand comprising:

a) an elongated base member;

b) a fitting, in slidable engagement with said base member;

c) a means for infinitely positioning and locking said fitting relative to said base member;

d) an extension member in telescopically engagement with said fitting, said extension member including a U-shaped saddle member attached to one end;

e) a means for infinitely positioning and locking said extension member relative to said fitting; and f) a clamping means for attaching said base member to said hunting stand.

2. A gun rest according to claim 1 wherein said base member further includes a removable cap at each end.

3. A gun rest according to claim 2 wherein said U-shaped saddle member is internally lined with a padding material.

4. A gun rest according to claim 1 wherein said fitting further includes a polymeric means to aid in maintaining said fitting in alignment relative to said base member.

5. A gun rest according to claim 1 wherein said fitting is rotatable relative to said base member.

6. A gun rest for attachment to a hunter's tree stand comprising:

a) an elongated tubular base member;

b) a tubular tee fitting externally slidable along and rotatable about said tubular base member, said tubular tee fitting comprising;

i) a hollow body portion having first and second ends;

ii) a hollow branch portion perpendicular to and intersecting said hollow body, intermediate said first and second ends, said branch portion being longer than said hollow body;

c) an elongated, tubular, extension member, having a U-shaped saddle member effectively shaped and dimensioned for receiving a rifle at one end, said elongated tubular extension member being telescopically inserted into said elongated, hollow branch portion of said tubular tee fitting;

d) a clutch nut means, threadably attached to one end of said tubular tee fitting, hollow body portion, and end of said branch portion for releaseably securing said tee fitting relative to said elongated, tubular, extension member and said tubular base member; and e) a clamping means for attaching said elongated, tubular, base member to said hunting, tree stand in a manner whereby said elongated, tubular, extension member is slidable and pivotal relative said base member.

7. A gun rest according to claim 6 wherein said tubular base member further includes a removable resilient cap at each end.

8. A gun rest according to claim 6 wherein said tubular tee fitting further includes an internal grommet located at one of said ends of said body portion to aid in maintaining said tubular tee in frictional contact and concentric alignment relative to said tubular base member.

9. A gun rest according to claim 8 wherein said U-shaped saddle member is internally lined with a padding material.

10. A gun rest according to claim 6 wherein said tubular tee fitting is rotatable relative to said base member.

11. A gun rest according to claim 10 wherein said clamping means is a U-bolt and bar assembly for clamping said base member to said hunter's tree stand.

* * * * *